United States Patent [19]

Trame

[11] Patent Number: 4,827,644

[45] Date of Patent: May 9, 1989

[54] TAMBOUR-TYPE SIGN

[75] Inventor: Charles E. Trame, Mequon, Wis.

[73] Assignee: Everbrite Electric Signs, Inc., Greenfield, Wis.

[21] Appl. No.: 64,695

[22] Filed: Jun. 22, 1987

[51] Int. Cl.[4] ..... G09F 11/12

[52] U.S. Cl. ..... 40/472; 40/518; 40/524

[58] Field of Search ..... 40/472, 524, 525, 508, 40/528, 473, 518, 489, 484; 160/201; 362/234.4, 234.5, 297; 74/413, 438, 421 R, 421 A

[56] References Cited

U.S. PATENT DOCUMENTS

| | | | |
|---|---|---|---|
| 644,954 | 3/1900 | Wales | 70/413 |
| 1,010,802 | 12/1911 | Rhodes | 40/484 |
| 2,204,868 | 6/1940 | Russell et al. | 40/472 |
| 2,847,782 | 8/1958 | Muse | 40/472 |
| 2,850,088 | 9/1958 | Purdy | 160/201 |
| 3,335,512 | 8/1967 | Newman | 40/472 |
| 3,782,215 | 1/1974 | Moody | 74/413 |
| 4,175,345 | 11/1979 | Rutchik | 40/473 |
| 4,577,428 | 3/1986 | Trame | 40/518 |

FOREIGN PATENT DOCUMENTS

| | | | |
|---|---|---|---|
| 2421259 | 11/1979 | France | 160/201 |
| 2052124 | 1/1981 | United Kingdom | 40/472 |

*Primary Examiner*—Robert Peshock
*Assistant Examiner*—Michael Lynch
*Attorney, Agent, or Firm*—Fuller, Puerner & Hohenfeldt

[57] ABSTRACT

A tambour-type sign has carrier bars hinged together to form a closed loop. The bars provide for inserting strips which display information. Pin and socket elements are formed on opposite edges of each carrier bar for the pin of one to engage in the socket of the next one to form a hinge. The loop is translated on a ring gear having internal teeth and a periphery in which there are equiangularly spaced apart grooves into which the sockets on the hinges register as a chain would on a sprocket. The ring gear is journaled for rotation on a bearing member exemplified by a square having four walls, the corners of which are segments of a circle whose diameter is equal to the diameter between the tips of the ring gear teeth. This drive structure is mounted on the laterally spaced apart support members so as to support the loop at both ends of the carrier bars. There are spaced apart pinions fixed on the cross shaft which engage with the respective ring gears. The shaft is motor driven. One end of the loop runs over similarly constructed ring gear and bearing assembly which are idlers.

6 Claims, 3 Drawing Sheets

TAMBOUR-TYPE SIGN

BACKGROUND OF THE INVENTION

This invention relates to a sign such as is used in fast food restaurants and stores to display names of items that are on sale and their prices.

An important objective achieved with the new display sign is to provide for presenting different classes of information to viewers in correspondence with changes of circumstances. For example in fast food restaurants it is desirable to display only the menu that pertains to the particular meal that is appropriate to the time of the day such as breakfast, lunch or dinner and to conceal from customers menus which apply to the meals not customarily served at that time so as to prevent customers from ordering food items that are not prepared for serving.

SUMMARY OF THE INVENTION

In accordance with the invention, item identification and price information are printed on plastic strips. The letters and numerals composing the information are usually translucent and the background is usually opaque. These strips are slid into slots in carrier bars superposed over windows in the bars. The carrier bars are hinged together to form a closed loop or belt comprised of parallel laterally extending carrier bars. Means are provided to translate vertical runs of the loop to present different groups of information, such as different menus and their prices, on the front side of the loop to be observed by customers.

A unique, simple and compact drive mechanism is provided for translating the loop. The drive system comprises a pair of laterally extending shafts, one of which is driven by power derived from an electric motor and the other of which is an idler. The driven shaft has two laterally spaced apart pinion gears on it. The pinions are adjacent the walls of a shell-like end cap. The end caps may have a square, block-like riser whose four corners are formed as segments of a circle. A ring gear having internal teeth fits over the curved segments which serve as bearing surfaces for the gear. The teeth of the pinion mesh with the internal teeth of the ring gear for driving the gear. The outside periphery of the ring gear has uniformly circumferentially spaced apart recesses. The carrier bar loop runs over the peripheries of the ring gears and the individual carrier bars in the loop are provided with means for engaging the recesses so that when the ring gear is turned the loop comprised of parallel carrier bars will translate. Sources of light are arranged inside of the loop to illuminate the information on the strips. There are devices which supply price information by way of numerals on movable tapes latched on to the inside of the carrier bars. When changing a price is desired, the devices are indexed by the human hand without withdrawal from the sign. One or more of the tapes are translated to cause different numerals, and, hence, different price information to be displayed. Items which are priced can be changed by substituting item identification strips.

A more detailed description of a preferred embodiment of the invention will now be set forth in reference to the drawings.

DESCRIPTION OF A PREFERRED EMBODIMENT

Figure 3:
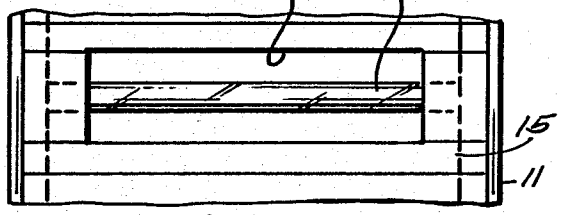
FIG. 3 is a fragment of the sign, looking at its rear, showing an access opening which would be used for maintenance such as changing fluorescent lamps or altering numerical information that is displayed by the sign.
Figure 2:
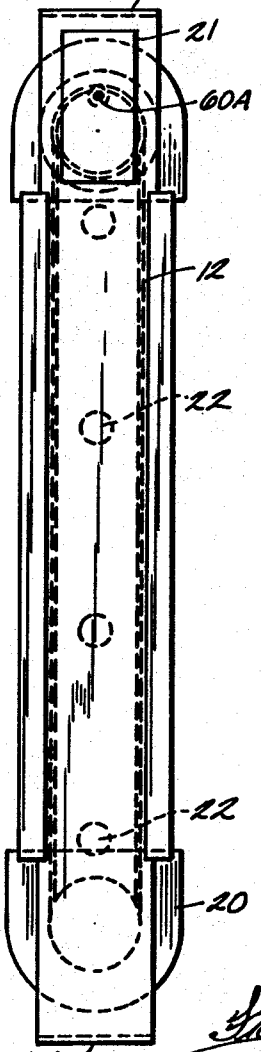
FIG. 2 is a right side elevational view of the sign shown in the preceding figure.
Figure 1:
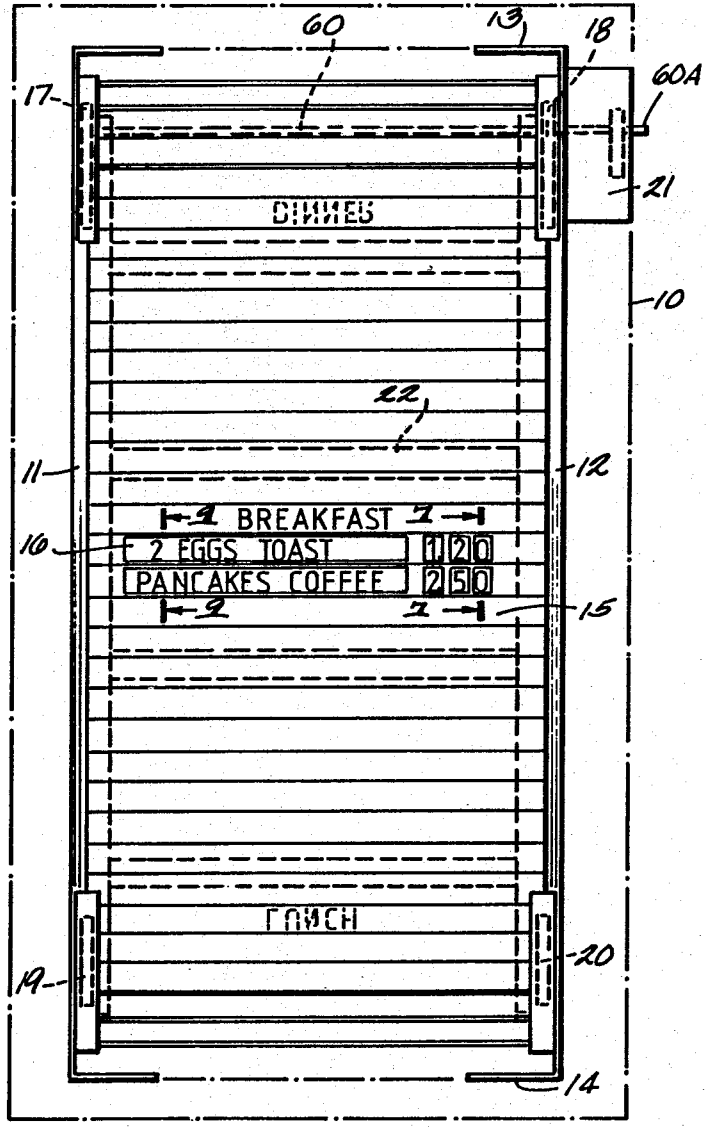
FIG. 1 is a front elevational view of the new tambour-type sign before it is installed in a housing.

FIG. 1 shows the new sign assembly isolated from the housing in which it is normally installed. The housing is symbolized by the dashed line rectangle marked 10. The sign comprises two laterally spaced apat side frame members 11 and 12 which have right angle bends 13 and 14 at their upper and lower ends for facilitating mounting the new sign assembly in a housing. The sign comprises a plurality of carrier bar members which are generally designated by the numeral 15. As will be explained in detail later, these carrier bars are articulated or hingedly connected to each other to form a closed loop belt-like structure which can be translated to cause presentation of different information to observers of the front of the sign. The carriers are provided with means for holding strips 16, usually of plastic material, on which the names of items, such as those shown in FIG. 1 are printed. Typically, the numerals and letters are transluscent and the background is opaque so that the printed information is easily legible to an observer. Prices that are displayed next to the ends of the exchangable item strips 16 are displayed in a different manner as will be explained in greater detail later. There are laterally spaced apart drive mechanisms 17 and 18 near the top of the sign assembly and there are laterally spaced apart idler mechanisms 19 and 20 at the lower end of the sign. The drive motor for the articulated carrier bar belt is in a housing 21 as shown in FIGS. 1 and 2. Between the front and rear vertical runs of the carrier belt loop there are light sources which are preferably fluorescent tubes whose ends 22 appear as dashed line circles in FIG. 2 and as transversely extending parallel dashed lines in FIG. 1. FIG. 3 shows how a few of the carrier bars 15 are modified to provide a window 25 for allowing entry to the space between the front and rear runs of the articulated carrier bar belt for changing fluorescent tubes and performing other servicing operations as will be elaborated later.

Figure 5:
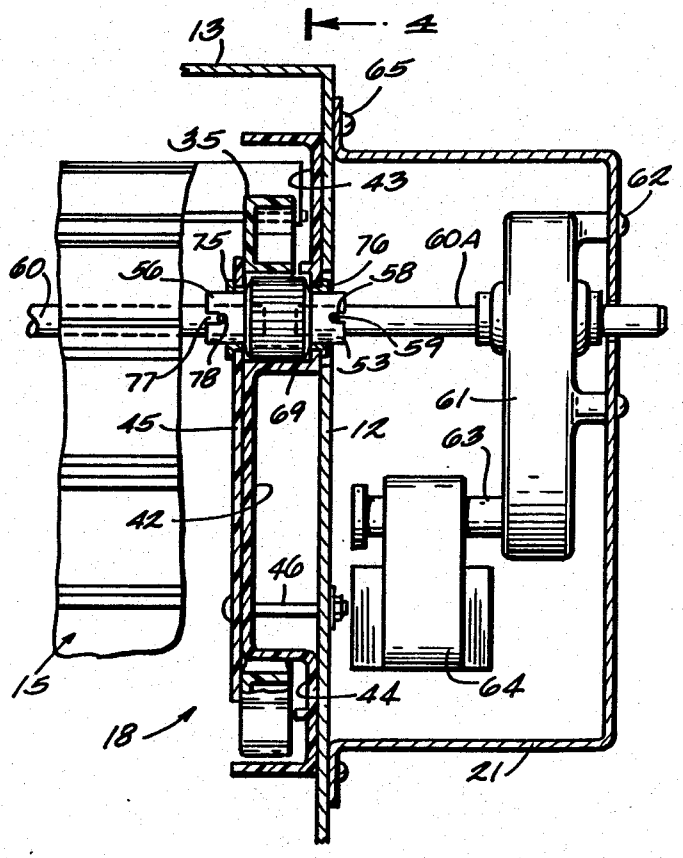
FIG. 5 is a sectional view of the compact drive mechanism showing a fragment of the carrier bar loop and the motor drive system too.
Figure 4:
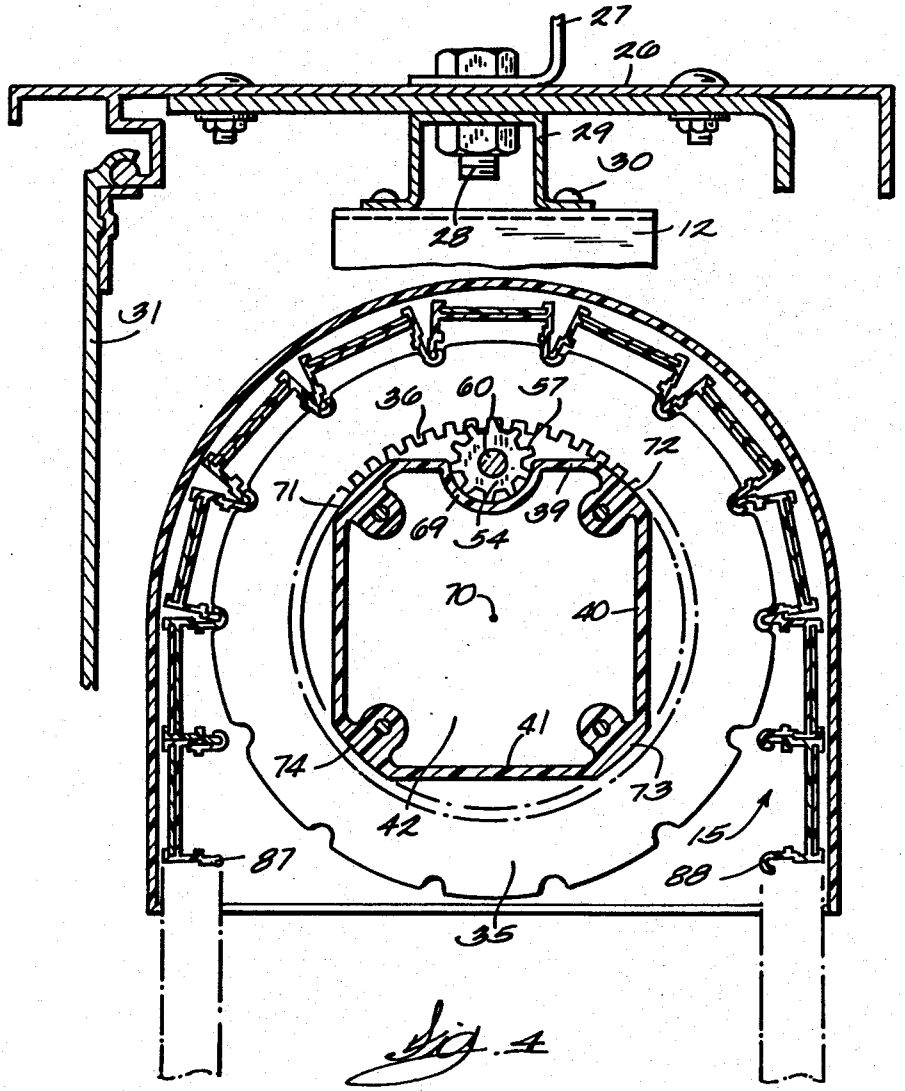
FIG. 4 is a side elevational sectional view of part of the sign drive mechanism taken on a line corresponding to 4—4 in FIG. 5.

The mechanism for translating the articulated carrier bar belt will now be discussed in greater detail in reference to FIGS. 4–6, primarily. FIG. 4 shows some parts of the housing for the new sign assembly. The housing includes a flat top member 26 to which a lift hook 27 is fastened with a bolt 28. The bolt also secures a bracket 29. Bracket 29 is secured to typical side member 21 of the new sign assembly. The housing is provided with swinging door 31 to provide for reaching the access window 25.

FIG. 4 shows a ring gear 35 which is part of the mechanism for driving the articulated carrier bar belt translationally. The ring gear is shown in isolation in FIG. 6. It has internal gear teeth 36 and a plurality of circumferentially spaced apart recesses 37 in its periphery. The recesses are semicircular in cross section. As illustrated in FIG. 4, ring gear 35 is journaled on a bearing member riser having four walls 38–41 which are shown in section to illustrate that the surface 42, which is visible in FIG. 5, has been cut away. The walls are integral parts of a cap member which, as shown in FIG. 5, has flanged portions 43 and 44 which bear on flat side member 12. The cap has a circular cover plate 45 which is secured to end closure 42 by means of bolts 46 which also secure the cap to the side wall 12. In an actual embodiment, the end cap is a unitary part made by injection molding a nylon composite having built-in lubricity. Ring gear 35 is desirably injection molded polycarbonate composite with built-in lubricity.

Figure 6:
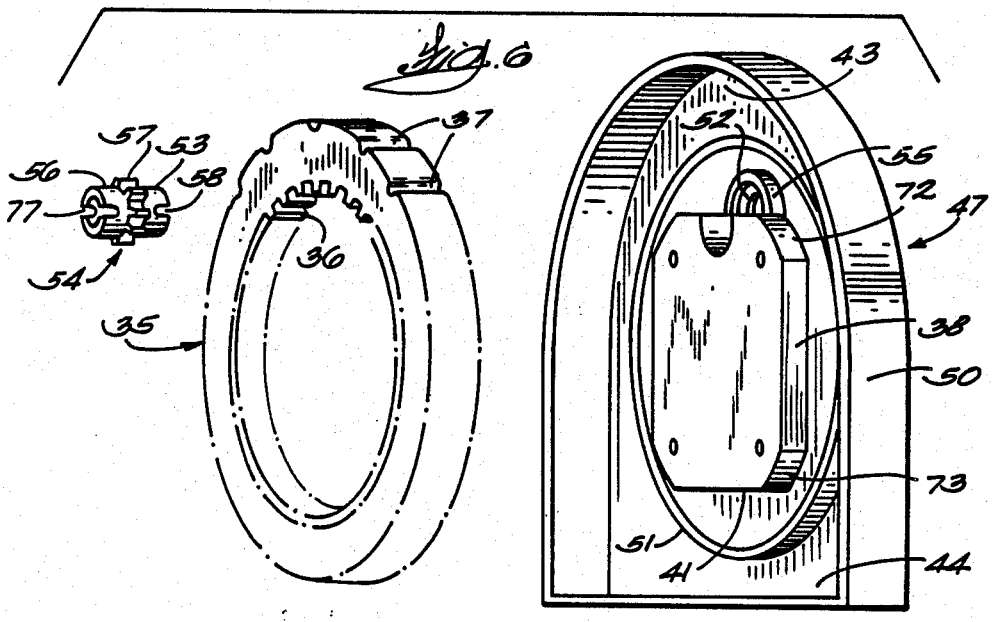
FIG. 6 is an exploded view of the pinion, the articulated belt transport gear and an end cap which, among other things, serves as a bearing for the ring gear.

The end cap is designated generally by the numeral 47 in FIG. 6. It comprises upper and lower flange wall areas 43 and 44 which were previously mentioned in reference to FIG. 5. It also has an integral shroud 50 and the rear wall has an annular boss 51 molded integrally with it. There is a hole 52 in the back wall through which one of the collars 53 of the pinion 54 shown in FIG. 6 extends. Hole 52 has a rim 55 surrounding it and this rim is molded integrally with a single piece cap member 47. Pinion 54 has a second collar 56 and there are gear teeth 57 between the collars. The collars are notched as at 58 for receiving a driver roll pin 59 which extends through a drive cross shaft 60A projecting from a gear reduction device 61. The gear reduction device is fastened to the inside of a cover 21 by means of screws 62. Power input to the gear reduction device 61 is by way of a shaft 63 projecting from an electric motor 64. The housing 21 for the motor and gear reduction device is secured to side frame member 12 by means of screws 65. Removal of these screws permits taking the motor and gear reducer off of the device since the shaft 60A of the gear reducer can be uncoupled from the shoulder 53 of the pinion by simply withdrawing the shaft from the bore of the collar 53.

Referring to FIG. 4 again, observe that the four corners of the shell or riser comprised of walls 38–41 constitute segments 71–74 of a common circle. This circle is concentric to a point marked 70 which is coincident with the rotational axis of the ring gear 35. The diameter of the circle on which the segments 71–74 lie is equal to the inside diameter of the ring gear measured from the tip of a gear tooth on one side of the ring to a tip on a diametrically opposite tooth. Thus, the ring gear teeth slide on the segments 71–74 which permits the gear 35 to rotate with very low friction because of the lubricity that is built into the resins out of which the bearing surfaces and the gear are molded.

As shown in FIG. 4, the upper wall 39 of the bearing shell 47 has a curved substantially semicircular depression 69 in which teeth 57 of pinion 54 are concentric. As shown in FIG. 5, the collars or hubs 53 and 56 of the pinion are journaled in channel-shaped bushings 75 and 76. These bushings are simply rings which have radially extending shafts. Collar 56 has a slot 77 which receives a pin 78 that extends through cross-shaft 60. This cross-shaft delivers torque to a left side drive mechanism 17, identified in FIG. 1, which is comparable to the mechanism shown in FIG. 5. Of course, when motor 64 is energized, power is transmitted from the gear reducer 61 to shaft 60A and the pinion acts as a coupling to cross-shaft 60.

Figure 9:
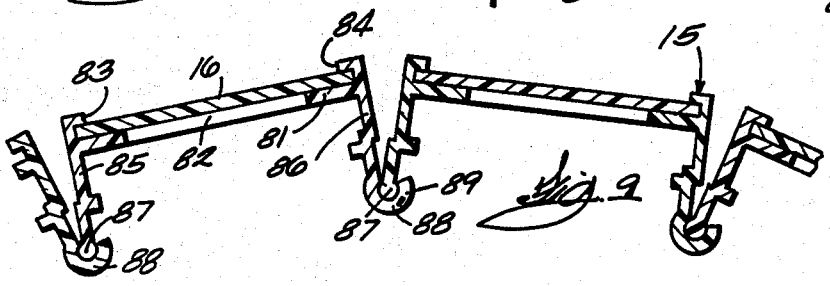
FIG. 9 is a section across the width of illustrative articulated carrier bars.

The manner in which the information-carrying articulated carrier bar belt is constructed will now be discussed. The closed loop carrier bar belt 6 is designated generally by the numeral 15 in FIG. 4 and a part of the belt as it would appear when flexing as it passes over the ring gear is shown in FIG. 9. The belt may be made up of extruded carrier bars. Referring to FIG. 9, a typical carrier bar is comprised of a flat bar 81 which has a lenghtwise extending window 82 in it. Window 82 is overlayed with a strip 16 on which information is printed and the printing becomes more easily legible as a result of the light emitted by the fluorescent lamps 22. The carrier bars have slots such as those marked 83 and 84 into which the information carrying strips 16 can be slid from the end of the carrier bar. There are legs 85 and 86 extending integrally from bar 81. Leg 85 terminates in an elongated cylinder comparable to a pin 87. The other leg 86 projecting integrally from bar 81 terminates in a curved end 88. The interior curve 89 of curved end 88 constitutes a socket and this socket is more than semicircular. Hence, a pin 87 from one carrier bar can be slid into the open end of the socket 87 of another carrier bar to form a hinge connection and resulting in an articulated closed loop of carrier bars 80 part of which loop is shown FIG. 4. Referring to FIGS. 4 and 9, one may see that the curved periphery 88 of the sockets are complementary in shape to the curved recessed 37 in the periphery of ring gear 35. Thus, the articulated carrier bar loop acts somewhat like a chain and the periphery of the ring gear 35 acts somewhat like a sprocket. Note in FIGS. 4 and 9 how the legs of adjacent carrier bars spread apart as the loop passes over the circular ring gear 35. The sockets and pins of the legs of the carrier bars extend over the entire length of the bars.

Figure 7:
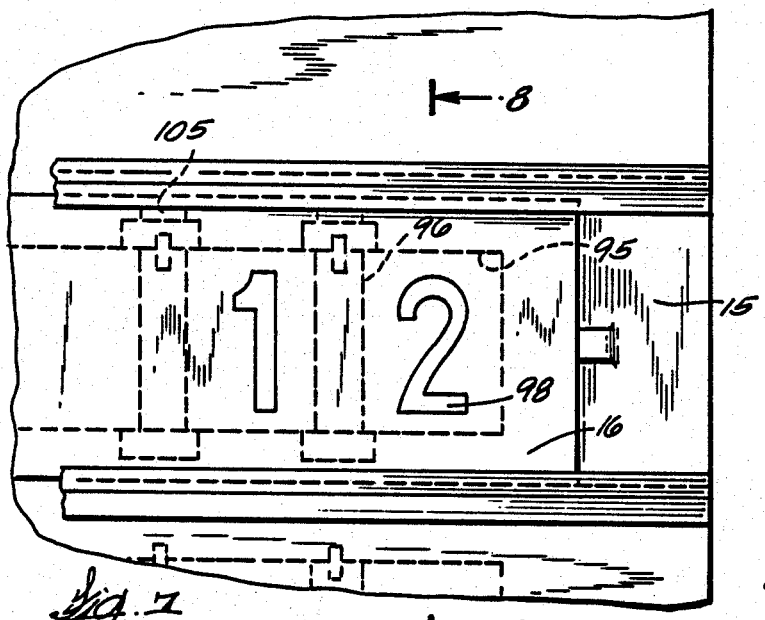
FIG. 7 shows a fragment of the front of the sign that is in the area in which numeric information such as the price of items is displayed.
Figure 8:
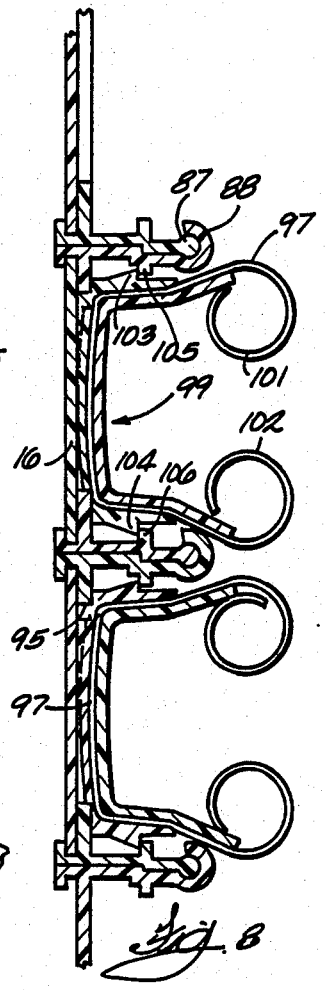
FIG. 8 is a vertical section taken on a line corresponding to 8—8 in FIG. 7.

The numerals constituting the prices of items named on strips 16 are displayed in a manner that will be explained in reference to FIGS. 7 and 8. First observe, however, in FIG. 1 that the numerals representing the prices are showing through a series of three windows in the carrier bars in this embodiment but there can be fewer windows and in some models there are more to allow display of larger price numbers such as is the case when the sign is used in some foreign countries. The strip 16 that slides into the carrier bars for exhibiting the items has a clear area which overlays the windows 95 in the carrier bars. As shown in FIG. 7, the windows 95 are separated by dividers 96. The price numerals are on tapes 97 which show through the windows and carry the price numerals 98. Behind these widows there are tape holders 99 having transparent tape supporting surfaces 100 on which the tapes can be slid. The tapes are of the self-coiling type and the coils at opposite ends are marked 101 and 102. These tape holders are similar to the tape holders described in U.S. Pat. No. 4,577,428 which is owned by the assignee of the invention described herein. The description of the tape holders and the manner in which they are used in that patent is incorporated herein by reference. It will be observed in FIG. 8, that the tape holders have resilient deflectable legs on which there are beveled ledges 103 and 104 which allow the tape holders to be pushed past a pair of shoulders 105 and 106 on the carrier bar legs. When the ledges on the tape holders pass the shoulders on the carrier bars, the ledges spring outwardly to retain the tape holders on the carrier bars. There are, of course, several tape holder sections formed in an integral piece behind the window in the strips 16.

Prices are changed by sliding the menu item strips 16 far enough to reveal the price tape holders. The price tapes are then indexed or translated with a finger or thumb in the desired direction. In some embodiments, not shown, the menu item strips 16 have apertures constituting windows in front of the price display tapes so the tapes can be accessed and indexed without sliding the item strips 16.

The cross-shaft 60 is shown in FIG. 1 as extending laterally across the sign where it joins with a drive mechanism 17 which is indicatd in FIG. 1. This drive mechanism has the end cap, pinion and ring gear arranged similarly to the drive mechanism previously described so drive mechanism 17 need not be described. At the bottom of the sign the articulated carrier bars run over idlers which were indicated generally by the numeral 19 and 20 in FIG. 1. These idlers can also be similar to the drive mechanisms 17 and 18.

I claim:

1. A sign comprising:

laterally spaced apart side support members, a rotatably driven shaft extending laterally between said support members and pinions on said shaft proximate to each support member, respectively, bearing means fixedly mounted adjacent said side support members, respectively, said bearing means each having a fixed bearing surface in the form of a segment of a circle generated from a central axis that is parallel to and displaced from the axis of said shaft, ring gears having on their inside peripheries teeth whose tips lie on circles that are concentric to said bearing surfaces, said gear teeth being journaled for slidable rotation on said bearing surfaces and said pinions respectively being meshed with said teeth of the ring gears for driving said ring gears in synchronism, a plurality of carrier bar members for carrying sign strips, said carrier bar members being hingedly connected to each other to form a closed loop, and means on said carrier bar members for engaging said loop with the outer peripheries of said ring gears for translating said carrier bar members in response to rotation of said ring gears by said pinions.

2. The apparatus according to claim 1 wherein said carrier bar members are hingedly connected by means of substantially circular elements fixed at corresponding one edges of said carrier bar members and socket elements fixed on said carrier bar members at edges opposite of said one edges, said circular elements on one carrier bar members being nested in the socket element of the next carrier bar member in the loop.

3. The apparatus according to claim 2 wherein said ring gear has grooves in its periphery that are circumferentially spaced apart by a distance substantially equal to the distance between socket elements on consecutive carrier bar members and said socket elements are complementarily shaped to said grooves for said socket elements to register in said grooves to effect translation of said loop.

4. The apparatus according to claim 1 wherein said bearing means for each ring gear comprises a unitary frame extending axially of said ring gear and encompassing a central opening, a part of said frame being formed as said segment of a circle, said frame being arranged inside of said ring gear and another part of said frame having a recess, said pinion extending into said recess for meshing with the internal teeth of said ring gear.

5. The apparatus according to claim 1 including a gear reduction device having power input and power output means, said power output means being coupled to said shaft, and an electric motor having a power output shaft coupled to said power input means.

6. The apparatus in any one of claims 1, 2, 3 or 4 wherein said carrier bar members are comprised of a plate portion having front and back faces containing a lengthwise extending window, elongated strips for containing printed information and means on said carrier bar members for holding said strips superposed over said window on the front face of said plate portion, said strips containing at least one window that is aligned with the window of the plate portion of a carrier bar member on which said strip is held, a tape holder and means on said back of the carrier bar member and on said holder cooperating to enable latching said holder to said carrier bar member adjacent said windows, said holder having a surface presented toward said window, and an indicia bearing tape supported on said holder for being moved over said surface to present said indicia in said window.

* * * * *